US010662489B2

(12) United States Patent
Larsen

(10) Patent No.: US 10,662,489 B2
(45) Date of Patent: May 26, 2020

(54) PELT BOARD AND A METHOD OF MANUFACTURING A PELT BOARD

(71) Applicant: MINKPAPIR A/S, Holstebro (DK)

(72) Inventor: Johnny Mollerup Larsen, Aalborg (DK)

(73) Assignee: MINKPAPIR A/S, Holstebro (DK)

( * ) Notice: Subject to any disclaimer, the term of this patent is extended or adjusted under 35 U.S.C. 154(b) by 248 days.

(21) Appl. No.: 15/744,388

(22) PCT Filed: Jul. 13, 2016

(86) PCT No.: PCT/EP2016/066619
§ 371 (c)(1),
(2) Date: Jan. 12, 2018

(87) PCT Pub. No.: WO2017/009371
PCT Pub. Date: Jan. 19, 2017

(65) Prior Publication Data

US 2018/0209003 A1 Jul. 26, 2018

(30) Foreign Application Priority Data

Jul. 13, 2015 (EP) ..... 15176468

(51) Int. Cl.
*C14B 15/06* (2006.01)
*C14B 1/58* (2006.01)
*C14B 1/26* (2006.01)

(52) U.S. Cl.
CPC ..... *C14B 15/06* (2013.01); *C14B 1/26* (2013.01); *C14B 1/58* (2013.01); *C14B 2700/07* (2013.01)

(58) Field of Classification Search
CPC .. C14B 15/06; C14B 1/26; C14B 1/58; C14B 2700/07

(Continued)

(56) References Cited

U.S. PATENT DOCUMENTS 1,110,016 A 9/1914 Thorpe
1,731,144 A * 10/1929 Lord ..... C14B 1/26 69/19.2

(Continued)

FOREIGN PATENT DOCUMENTS

DK 177480 7/2013
DK 177582 10/2013

(Continued)

OTHER PUBLICATIONS

Translation of DK201500045, Agerbo, Poul, Jun. 12, 2015, translated by Google on Nov. 12, 2019 (Year: 2015).*

(Continued)

*Primary Examiner* — Heather N Mangine

(74) *Attorney, Agent, or Firm* — Klein, O+Neill & Singh, LLP

(57) ABSTRACT

An elongated pelt board for accommodating an animal pelt. The pelt board defines a blunt end and an opposite pointed end and a longitudinal direction. The pelt board further defines a first radial direction perpendicular to the longitudinal direction and a second radial direction perpendicular to the longitudinal direction and the first radial direction, said pelt board comprising a first part at said blunt end and an opposite second part at said pointed end. The first part comprises a first wall element and a second wall element. The first and second wall elements are of identical configuration. The first wall element and said second wall element define a contracted state and an expanded state.

21 Claims, 6 Drawing Sheets

(58) Field of Classification Search
USPC ..... 69/19.2, 19, 19.1, 19.3
See application file for complete search history.

(56) References Cited

U.S. PATENT DOCUMENTS

| | | | | |
|---|---|---|---|---|
| 2,231,903 | A * | 2/1941 | Graham | C14B 1/26 69/19.2 |
| 2,493,924 | A | 1/1950 | Mowad | |
| 3,137,963 | A | 6/1964 | Hein | |
| 3,313,038 | A | 4/1967 | Bolz | |
| 3,526,967 | A | 9/1970 | Bolz | |
| 4,389,795 | A * | 6/1983 | Craggs | C14B 15/06 34/103 |
| 6,915,669 | B2 | 7/2005 | Hedegaard | |
| D611,965 | S * | 3/2010 | Hedegaard | D15/78 |
| 7,690,228 | B2 | 4/2010 | Hedegaard | |
| 7,987,795 | B2 * | 8/2011 | Hedegaard | B61B 13/04 104/119 |
| 9,493,852 | B2 | 11/2016 | Frolund | |
| D809,372 | S | 2/2018 | Palsgaard et al. | |
| 10,323,290 | B2 * | 6/2019 | Larsen | C14B 17/08 |
| 2015/0191802 | A1 * | 7/2015 | Pedersen | C14B 15/06 69/19.2 |
| 2015/0250137 | A1 | 9/2015 | Palsgaard et al. | |
| 2017/0260597 | A1 * | 9/2017 | Larsen | C14B 15/06 |
| 2018/0030556 | A1 | 2/2018 | Larsen et al. | |
| 2018/0057900 | A1 | 3/2018 | Andersen et al. | |
| 2018/0209003 | A1 * | 7/2018 | Larsen | C14B 1/58 |
| 2018/0245170 | A1 * | 8/2018 | Larsen | C14B 1/58 |
| 2019/0017127 | A1 | 1/2019 | Larsen | |

FOREIGN PATENT DOCUMENTS

| | | |
|---|---|---|
| DK | 201300091 | 11/2013 |
| DK | 201500045 | 6/2015 |
| DK | 201500047 | 6/2015 |
| EP | 3037557 | 6/2016 |
| WO | WO82/03634 | 10/1982 |
| WO | WO01/62985 | 8/2001 |
| WO | WO2005/026394 | 3/2005 |
| WO | WO2005/080607 | 9/2005 |
| WO | WO2014/032950 | 3/2014 |
| WO | WO2015/144774 | 10/2015 |
| WO | WO2015/144777 | 10/2015 |
| WO | WO2017/118721 | 7/2017 |

OTHER PUBLICATIONS

Danish patent application No. DK 2003 01592; Filed on Oct. 28, 2003; Inventor: Jens Hedegaard.

International Search Report on corresponding PCT application (PCT/EP2015/056431) from International Searching Authority (EPO) dated Jun. 15, 2015.

Written Opinion on corresponding PCT application (PCT/EP2015/056431) from International Searching Authority (EPO) dated Jun. 15, 2015.

International Search Report on related PCT application (PCT/EP2015/056441) from International Searching Authority (EPO) dated Sep. 3, 2015.

Written Opinion on related PCT application (PCT/EP2015/056441) from International Searching Authority (EPO) dated Sep. 3, 2015.

Non-Final Office Action on co-pending U.S. application (U.S. Appl. No. 15/128,677) dated Jun. 5, 2018.

International Search Report on corresponding PCT application (PCT/EP2016/066619) from International Searching Authority (EPO) dated Nov. 30, 2016.

Written Opinion on corresponding PCT application (PCT/ EP2016/066619) from International Searching Authority (EPO) dated Nov. 30, 2016.

* cited by examiner

PELT BOARD AND A METHOD OF MANUFACTURING A PELT BOARD

CROSS-REFERENCE TO RELATED APPLICATIONS

This application is the national phase entry, under 35 U.S.C. Section 371(c), of International Application No. PCT/EP2016/066619, filed Jul. 13, 2016, claiming priority from European Application No. 15176468.5, filed Jul. 13, 2015. The disclosures of the International Application and the European Application from which this application claims priority are incorporated herein by reference in their entireties.

FEDERALLY SPONSORED RESEARCH OR DEVELOPMENT

Not Applicable

The present invention relates to an elongated pelt board for accommodating an animal pelt, and a method of manufacturing a pelt board for accommodating an animal pelt.

BACKGROUND

In the drying of pelts, e.g. mink or fox pelt, after skinning and scraping off the layer of fat on the leather side of the pelt, the pelts are typically stretched on a pelt board which is often provided with a fat-absorbing material with the object of removing the remaining fat on the leather side of the pelt.

The use of pelt boards in connection with the drying of pelts is well known in the prior art and there has in the past been developed a great number of configurations of such pelt boards. There has also been established a standard of pelt sizes and thus also of pelt boards.

The most widespread pelt boards in the past were made of wood, and may in short be described as a flat piece of wood defining a longitudinal direction and having in the longitudinal direction a first broadside surface, a second broadside surface, a first narrow side surface and a second narrow side surface. One end of the board, the bottom end, is cut off at right angles to the longitudinal direction. The lower end adjacent the bottom has a constant breadth, which breadth gradually decreases towards a pointed and rounded end approaching the top end of the board. Such boards typically also have a longitudinal slot for allowing air to pass.

The drying procedure of the pelt shall be understood to be a drying-out of the leather side of the pelt to an extent which by experience prevents any attack on the pelt by mites. The drying process is typically effected by the blowing of dry air in the slot on the board via pipes which are introduces into the slot, where via the perforations in the walls of the pelt bag the dry air is diffused out of the leather side of the pelt and dries the pelt.

From WO 01/62985 is known a bag shaped holster, which is referred to as a fixing bag, which is used for securing the pelts on a pelt board during the drying process. The fixing bag is drawn over the board with the stretched pelt from the cranium end of the pelt so that the fur side of the pelt is in tight contact with the fur, which results in the pelt being pressed against the board with a force which is sufficient for the pelt to remain substantially in the stretched position during the drying.

Further prior art includes U.S. Pat. No. 3,137,963 in which a pelt board comprising a flat body of sheet metal having perforations therein and beads along the sides is disclosed.

In WO 2005/026394 is disclosed a pelt board which is lockable in a position, in which it has a first circumference and can also assume a position in which it has a second circumference being smaller than the first circumference by displacing opposing half parts in relation to each other. This results in a considerably easier removal of the pelt from the pelt board.

U.S. Pat. No. 1,110,016 relates to a pelt board having a pair of longitudinal legs and a nose piece located there between.

U.S. Pat. No. 3,526,967 relates to a pelt drying system including an air conditioning unit for supplying temperature controlled air to a number of manifolds having nozzles onto which the pelt drying frames are attached.

WO 82/03634 relates to a pelting board of non-absorbing plastics having a plurality of channels near its edges to supply drying air to the edges of the board so that the pelt dry evenly and stick less often to the board.

U.S. Pat. No. 3,313,038 relates to a pelt drying frame comprising opposite side rods joined at a nose over which frame a pelt may be drawn and held taut.

DK 2012 70519 A1 relates to a pelt board has a lower part and an upper part. The lower part has an outer cross section circumference which is substantially constant and the upper part has an outer cross section which is gradually decreasing.

DK 2013 00091 U4 relates to a pelt board has a lower part and an upper part. The lower part has an outer cross section circumference, which is substantially constant and the upper part has an outer cross section which is gradually decreasing. The lower part extends between 36 cm and 50 cm.

DK 177480 B1 discloses a pelt board having two broad elongated side surfaces. The pelt board comprises expansion means defining a narrow elongated side surface extending between side edges of the broad side surfaces. The expansion means are movable between an expanded position and a non-expanded position.

Some of the above pelt boards have an outer circumference made up of opposing non-movable surfaces and opposing movable surfaces. Pelt boards having this variable circumference for simplifying the removal of the pelt after drying are thus known in the prior art. The pelt boards are thus expanded during the drying process. As the pelt is fixated firmly during drying and may shrink slightly, the pelts may be difficult to remove from the pelt boards. Further, the pelts are typically fixated in a stretched state, thus increasing the pressure of the pelt onto the pelt board. By reducing the circumference of the pelt board, the pelt will be easier to remove from the pelt board.

However, the pelt boards used until now only feature a limited variation in the circumference in that only a limited part of the circumferential surfaces are moving/may be reduced. Although the pelt board according to the prior art may alter the total circumference and thereby relax the pelt, it has been noticed by the applicant that the pelt in some circumstances may still stick quite firm onto the pelt board at the locations of the pelt board at which the surface or circumference has not been reduced.

It is thus an object according to the present invention to provide technologies for simplifying the removal of the pelts from the pelt boards and avoiding the situations where the pelt due to the drying and stretching may stick to the pelt board, and at the same time ensure that the pelt board keeps a substantially elliptical circumference in order to distribute the inwardly oriented pressure of the pelt evenly over the pelt board.

It is an advantage according to the present invention that the pelt board may be locked in the expanded position and that the movement between the expanded position and the reduced position may be performed very accurately using very little force.

It is a feature according to the present invention that the pelt board may be modified to accommodate pelts of different sizes and shapes.

SUMMARY OF THE INVENTION

The above object, the above features and the above advantage together with numerous other objects, advantages and features, which will be evident from the below detailed description of the present invention, are according to a first aspect of the present invention obtained by an elongated pelt board for accommodating an animal pelt, said pelt board defining a blunt end and an opposite pointed end and defining a longitudinal direction therebetween, said pelt board further defining a first radial direction perpendicular to said longitudinal direction and a second radial direction perpendicular to said longitudinal direction and said first radial direction, said pelt board comprising a first part at said blunt end and an opposite second part at said pointed end, said first part comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration said first inwardly oriented surface and said second inwardly oriented surface together defining a first cavity along said longitudinal direction, said first wall element and said second wall element defining:

a contracted state in which said longitudinal edges of said first wall element being positioned juxtaposed said longitudinal edges of said second wall element, and an expanded state in which said first longitudinal edges of said first wall element and said longitudinal edges of said second wall element being shifted away from one another relative to said contracted state along said first radial direction and/or along said second radial direction, and a first elongated core element extending within said first cavity along said longitudinal direction and being movable in relation to said first wall element and said second wall element, said first elongated core element comprising a first cooperating member interacting with said first actuator member of said first wall element and a second cooperating member interacting with said second actuator member of said second wall element, for allowing said first wall element and said second wall element, to selectively define said contracted state or said expanded state by moving said first elongated core element in said longitudinal direction relative to said first wall element and said second wall element, and said second part comprising:

a third wall element extending along said longitudinal direction and defining a third outwardly oriented surface, a third inwardly oriented surface, a third set of oppositely located longitudinal edges and a third actuator member, a fourth wall element extending along said longitudinal direction and defining a fourth outwardly oriented surface, a fourth inwardly oriented surface facing said third inwardly oriented surface, a fourth set of oppositely located longitudinal edges and a fourth actuator member, said third wall element and said fourth wall element being of identical configuration said third inwardly oriented surface and said fourth inwardly oriented surface together defining a second cavity along said longitudinal direction, said third wall element and said fourth wall element defining:

a non-extended state in said longitudinal direction in which said second part is positioned juxtaposed said first part and said third set of oppositely located longitudinal edges and said fourth set of oppositely located longitudinal edges constitute extensions of said first set of oppositely located longitudinal edges and said second set of oppositely located longitudinal edges, respectively, and an extended state in which said second part is spaced from said first part along said longitudinal direction as said third set of oppositely located longitudinal edges and said fourth set of oppositely located longitudinal edges are not constituting extensions of said first set of oppositely located longitudinal edges and said second set of oppositely located longitudinal edges, respectively, and a second elongated core element extending within said second cavity along said longitudinal direction and being movable in relation to said third wall element and said fourth wall element, said second elongated core element comprising a third cooperating member interacting with said third actuator member of said third wall element and a fourth cooperating member interacting with said fourth actuator member of said fourth wall element for allowing said third wall element and said fourth wall element to selectively define said non-extended state or said extended state in said longitudinal direction by moving said second elongated core element in said longitudinal direction relative to said third wall element and said fourth element.

The above object, the above features and the above advantage together with numerous other objects, advantages and features, which will be evident from the below detailed description of the present invention, are according to a second aspect of the present invention obtained by an elongated pelt board for accommodating an animal pelt, said pelt board defining a blunt end and an opposite pointed end and defining a longitudinal direction therebetween, said pelt board further defining a first radial direction perpendicular to said longitudinal direction and a second radial direction perpendicular to said longitudinal direction and said first radial direction, said pelt board comprising a first part at said blunt end and an opposite second part at said pointed end, said first part defining an open end at said pointed end comprising:

a first wall element extending along said longitudinal direction and defining a first outwardly oriented surface, a first inwardly oriented surface, a first set of oppositely located longitudinal edges and a first actuator member, a second wall element extending along said longitudinal direction and defining a second outwardly oriented surface, a second inwardly oriented surface facing said first inwardly oriented surface, a second set of oppositely located longitudinal edges and a second actuator member, said first wall element and said second wall element being of identical configuration said first inwardly oriented surface and said second inwardly oriented surface together defining a first cavity along said longitudinal direction, said first wall element and said second wall element defining:

a contracted state in which said longitudinal edges of said first wall element being positioned juxtaposed said longitudinal edges of said second wall element, and an expanded state in which said first longitudinal edges of said first wall element and said longitudinal edges of said second wall element being shifted away from one another relative to said contracted state along said first radial direction and/or along said second radial direction, and a first elongated core element extending within said first cavity along said longitudinal direction and being movable in relation to said first wall element and said second wall element, said first elongated core element comprising a first cooperating member interacting with said first actuator member of said first wall element and a second cooperating member interacting with said second actuator member of said second wall element, for allowing said first wall element and said second wall element, to selectively define said contracted state or said expanded state by moving said first elongated core element in said longitudinal direction relative to said first wall element and said second wall element, and said second part comprising:

a closure element for closing off said open end of said first part and defining:

a non-extended state in said longitudinal direction in which said closure element of said second part is positioned juxtaposed said first part, and an extended state in which said closure element of said second part is spaced from said first part along said longitudinal direction, and a second elongated core element connected to said closure element and extending within said first cavity along said longitudinal direction and being movable in relation to said first part to selectively define said non-extended state or said extended state in said longitudinal direction.

The pelt board should have an overall size which is suitable for accommodating a pelt of an animal such as a mink or fox. The pelt board typically has a substantially elliptic cylindrical shape which is tapering in the longitudinal direction. The pelt is applied onto the pelt board by drawing in onto the pelt board in the longitudinal direction, while the pelt board assumes its expanded state. It is understood that state of the art pelt bags may be used between the pelt and the pelt board in order to remove fatty substances from the pelt. The wall elements typically include a large number of holes or nozzles for allowing ventilation air to pass from the cavity within the pelt board to the outside through the pelt.

The first and second elongated core elements may be positioned in any arbitrary configuration and positioning within the first cavity and may in a specific embodiment of the elongated pelt board be joined at the transition from the first part to the second part through a threaded connection allowing the second elongated core element to be operated through actuating the first core element, however, independent from the actuation of the first core element. In the presently preferred embodiment of the pelt board according to the first and second aspects of the present invention, the second elongated core element, however, extends in a passage preferably a throughgoing passage within the first elongated core element to the blunt end. At the blunt end, the elongated pelt board, according to the first and the second aspects of the present invention, preferably has a freely extending connector element known in the prior art as a "stubby projecting element" and serving for connecting the pelt board to an apparatus for the processing of the pelt constituting a so-called tanning machine and also for connecting and arranging the pelt board with a pelt positioned thereon in an upright position received on a drying apparatus constituted by a machine in which apertures are provided for receiving the connector element and serving to allow air to be blown into the first cavity of the pelt board for accomplishing the drying of the pelt received on the pelt board.

The first and second wall elements together define the substantially elliptical outer circumference of the pelt board, which is suitable for and adapted for accommodating a pelt of an animal, through its respective outwardly oriented surfaces. The inwardly oriented surfaces may preferably define a concave shape, which surfaces together define the cavity in the pelt board. The wall elements are typically made of plastics. The wall elements are further delimited in the circumferential direction by longitudinal edges.

In the elongated pelt board according to the first and second aspects of the present invention, the first elongated core element, which is located in the first cavity, is movable in the longitudinal direction in relation to the first and second wall elements. The actuator members of the wall elements and the cooperating members of the first core element interact when the first core element is moved in the longitudinal direction within the first cavity. The cooperating members move in the longitudinal direction together with the first elongated core whereas the actuator members move in any of the radial directions along with its respective first and second wall element. The interaction between the cooperating members and the actuator members translate the longitudinal movement of the cooperating members to a radial movement of the actuator members.

The actuator members and the cooperating members thus cause the first and second wall elements to move towards each other or away from each other in the respective first or second radial direction, thus making the cavity smaller or larger, when the first core element is moved in the longitudinal direction relative to the first and second wall elements. The first and second wall elements are thus movable between the contacted state, in which the first and second wall elements have moved towards each other, reducing the radial distances, and consequently the circumference of the pelt board and the cavity is small, and an expanded state in which the first and second wall elements have moved away from each other, increasing the radial distances and consequently the circumference of the pelt board and the cavity is large. Typically, an upward movement of the first elongated core element in relation to the first and second wall elements yields an expansion of the circumference of the pelt board, whereas a downward movement of the first elongated core element in relation to the first and second wall elements yields a contraction of the circumference of the pelt board.

The outer surface of the wall elements will constitute the contacts surface between the pelt and the pelt board, not taking into account the optional presence of a pelt bag between the pelt and the pelt board.

When in the expanded state, the circumference of the pelt board is large. In this state the pelt is applied to the pelt board, optionally using a pelt bag. During the drying process, the pelt looses fat and moist and consequently contracts slightly. It may thereafter be very difficult to remove the pelt from the board. By contacting the pelt board by moving the first and second wall element towards each other, the circumference of the pelt board defined by the outer surface of the first and second wall elements will be smaller and thus allow the pelt to loosen from the outer surfaces of the first and second wall elements, such that the pelt may be removed from the pelt board. In this context, the complete circumference of the pelt board will contract, effectively eliminating the risk of the pelt sticking to the pelt board.

In order to simplify the overlapping of the first and second wall elements and allow the gap between adjacent first and second wall elements to be minimized, the first and second wall elements may be partially flexible. Although it is fully feasible to realize an expansion and contraction of the pelt board via the first and second wall element using rigid wall elements, the thickness of the first and second wall element will typically prevent a fully flush outwardly oriented surface in the expanded state. By allowing the part of the first and second wall element which is going to be pushed below and/or above an adjacent wall element in the contracted state to be flexible in relation to the part of the wall element which is going to remain exposed to the pelt, the longitudinal edges of adjacent first and second wall elements may be caused to be fully flush or continuous in the expanded state.

According to a further embodiment of the pelt board according to the present invention, the first actuator member and the second actuator member constitute pins and the first cooperating member and the second cooperating member constitute grooves, e.g. linear or curved grooves, in which the pins are guided between the contracted state and the expanded state, or, wherein the first cooperating member and the second cooperating member constitute pins and the first actuator member and the second actuator member constitute grooves, e.g. linear or curved grooves, in which the pins are guided between the contracted state and the expanded state.

The above guiding principle using a pin which is guided by a groove allows a well defined movement of the wall elements. It is evident that the opposite configuration is equally feasible, i.e. having the first actuator member and the second actuator member constitute grooves, e.g. linear or curved grooves, and the first cooperating member and the second cooperating member constitute pins which are guided by the grooves between the contracted state and the expanded state, or any combination thereof. The longitudinal movement of the elongated core thus translates into a radial movement of the wall elements. The groove/pin configuration also allows for a very convenient latching of the wall elements and the core.

Another guiding principle is employed by using wedge members which exhibit an angle and may consequently slide outwardly when pushed. The longitudinal movement of the first elongated core element thus translates into a radial movement by interaction between the sloped members. This guiding principle may preferably be used when changing from said contracted state to said expanded state.

Yet another guiding principle is employed by using actuator members acting on the side of the elongated core element which is located opposite the wall element to be moved. The longitudinal movement of the elongated core element thus translates into a radial movement by interaction typically by using sloped members. This guiding principle may preferably be used when changing from said expanded state to said contracted state.

According to a further embodiment of the pelt board according to the present invention, the first wall element and the second wall element have an arched shape such that the first outwardly oriented surface and the second outwardly oriented surface define a convex shape. According to a still further embodiment of the pelt board according to the first aspect of the present invention, the third and fourth wall elements have also an arched shape such that the first and third outwardly oriented surfaces constitute a continuous surface in the non-extended state and similarly the second and fourth wall elements constitute a continuous wall in the non-extended state, and the first and third outwardly oriented surfaces and the second and fourth outwardly oriented surfaces define a respective convex shape.

Using a convex shape of the wall element or wall elements will allow the outer surfaces of the wall elements to adapt to the pelt, which typically has a cylindrical shape.

According to a further embodiment according to the present invention, the first wall element and the second wall element comprise ventilation grooves between the cavity and the outside of the pelt board.

Ventilation grooves may be present in order to allow dry air to be injected into the pelt for removing any remaining moisture in the pelt and thereby decrease the drying time of the pelt.

According to a further embodiment according to the present invention, the first wall element and the second wall element define an opening between the cavity and the outside of the pelt board at the bottom end for allowing ventilation air to enter the cavity.

The dry air injected into the pelt via the pelt board and used for decreasing the drying time of the pelt may be let into the pelt board via a cavity near the bottom end of the pelt board. The bottom end of the pelt board is typically as described above attachable to a drying unit for holding the pelt board in an upright position and for supplying the drying air.

In order to increase the rigidity of the pelt board and for allowing the pelt board to easily connect to a drying unit, the pelt board may assume the same circumference at the bottom end both in the expanded state and in the contracted state. This may be made by fixedly connecting the wall elements at constant distance relative to each other near the bottom end and allowing the flexibility of the wall elements to determine the movement of the lower portion of the pelt board. The lower extreme of the pelt board is typically not used for accommodating the pelt since the pelt boards are typically made longer than the longest pelts for which the pelt board is intended.

According to a further embodiment according to the present invention, the elongated core element comprises a first protrusion adjacent the bottom end, the elongated core element being spring-loaded at the bottom end and defining a centralized relaxed position and a non-centralized loaded position in the first radial direction and/or second radial direction, the first wall element and the second wall element comprise a second protrusion cooperating with the first protrusion such that when the first wall element and the second wall element define the expanded state and the elongated core element defines the centralized related position, the first and second protrusions prevent any longitudinal movement of the elongated core element, whereas when the elongated core element defines the non-centralized loaded position, the first and second protrusions allow longitudinal movement of the elongated core element.

In the state of the art expandable and contactable pelt boards, the pelt board is maintained in the expanded state merely due to the design of and internal friction between the movable parts of the pelt board. The friction increases with the pressure applied to the pelt board and although an increased friction may help keeping the pelt board in the expanded state also when a large inwardly pressure is applied from the pelt, it may also be very difficult to contract the pelt board. Experience has shown that after the drying, when the pelt has shrunk and thus applies a large pressure onto the pelt board, the users have to apply a large manual force to cause the pelt board to collapse. This work is very tedious and may lead to work related injuries.

The locking mechanism described above making use of cooperating protrusions for preventing movement of the elongated core element and thereby contraction of the pelt board allows the pelt board to remain in the expanded state even when exposed to very large inwardly oriented pressure, while reducing the amount of work needed for changing the pelt board into the contracted state. The first and second protrusions will interlock when the elongated core is in its central position, effectively preventing any longitudinal movement of the elongated core, which in turn prevents any radial movement of the wall elements.

By merely exposing the elongated core element to a small radial force, overcoming the friction between the first and second protrusion and the spring constant of the elongated core element, the inwardly oriented pressure from the dried pelt will cause the wall element to move inwardly and the pelt board to contact, while the elongated core element is moved in the longitudinal direction and the first protrusion is passing by the second protrusion. This mechanism will also be less prone to accidental activation since it is not depending on any hard to determine internal friction between the activation members and the cooperating members.

It is evident that the above locking mechanism may be used for a generic pelt board which does not necessarily have to encompass the four way expansion. Such pelt board may e.g. be defined as an elongated pelt board for accommodating an animal pelt, the pelt board defining a longitudinal direction, a first radial direction perpendicular to the longitudinal direction and a second radial direction perpendicular to the longitudinal direction and the first radial direction, the pelt board having a wall element and an elongated core element covered by the wall element, the wall element being capable of assuming an expanded state and a contacted state by longitudinal movement of the elongated core element, the elongated core element comprising a first protrusion adjacent a bottom end of the pelt board, the core element being spring-loaded at the bottom end and defines a centralized relaxed position and a non-centralized loaded position in the first radial direction and/or second radial direction, the wall element comprising a second protrusion cooperating with the first protrusion such that when the wall element define the expanded state and the elongated core element define the centralized related position, the first and second protrusions preventing any longitudinal movement of the elongated core element, whereas when the elongated core element define the non-centralized loaded position, the first and second protrusions allow longitudinal movement of the elongated core element.

The change from expanded state to contracted state may preferably be made when the bottom end of the elongated core element is attached to the drying unit, e.g. by tilting the pelt board sideways, thereby also taking advantage of the leverage provided by the pelt board for overcoming the friction between the first and second protrusions.

The above object, the above features and the above advantage together with numerous other objects, advantages and features which will be evident from the below detailed description of the present invention are according to a third aspect of the present invention obtained by a method of manufacturing an elongated pelt board for accommodating an animal pelt comprising:

- providing a first wall element defining a first outwardly oriented surface, a first inwardly oriented surface, a first set of oppositely located longitudinal edges and a first actuator member,
- providing a second wall element defining a second outwardly oriented surface, a second inwardly oriented surface, a second set of oppositely located longitudinal edges and a second actuator member,
- said first wall element and said second wall element being of identical configuration,
- positioning said first and second wall elements extending along a longitudinal direction and having said first inwardly oriented surface facing said second inwardly oriented surface together defining a first cavity along said longitudinal direction,
- said first wall element and said second wall element defining:
  - a contracted state in which said longitudinal edges of said first wall element being positioned juxtaposed said longitudinal edges of said second wall element, and
  - an expanded state in which said first longitudinal edges of said first wall element and said longitudinal edges of said second wall element being shifted away from one another relative to said contracted state along said first radial direction and/or along said second radial direction, and the method comprising:

- providing a first elongated core element and positioning said first elongated core element extending within said first cavity along said longitudinal direction and being movable in relation to said first wall element and said second wall element, said first elongated core element comprising a first cooperating member interacting with said first actuator member of said first wall element and a second cooperating member interacting with said second actuator member of said second wall element, for allowing said first wall element and said second wall element, to selectively define said contracted state or said expanded state by moving said first elongated core element in said longitudinal direction relative to said first wall element and said second wall element, and
- providing a third wall element defining a third outwardly oriented surface, a third inwardly oriented surface, a third set of oppositely located longitudinal edges and a third actuator member,
- providing a fourth wall element defining a fourth outwardly oriented surface, a fourth inwardly oriented surface, a fourth set of oppositely located longitudinal edges and a fourth actuator member, said third wall element and said fourth wall element being of identical configuration positioning said third and fourth wall elements extending along said longitudinal direction and having said third inwardly oriented surface facing said fourth inwardly oriented surface, and having said third inwardly oriented surface facing said fourth inwardly oriented surface together defining a second cavity along said longitudinal direction, said third wall element and said fourth wall element defining:

a non-extended state in said longitudinal direction in which said second part is positioned juxtaposed said first part and said third set of oppositely located longitudinal edges and said fourth set of oppositely located longitudinal edges constitute extensions of said first set of oppositely located longitudinal edges and said second set of oppositely located longitudinal edges, respectively, and an extended state in which said second part is spaced from said first part along said longitudinal direction as said third set of oppositely located longitudinal edges and said fourth set of oppositely located longitudinal edges are not constituting extensions of said first set of oppositely located longitudinal edges and said second set of oppositely located longitudinal edges, respectively, and the method comprising:

providing a second elongated core element and positioning said second elongated core element extending within said second cavity along said longitudinal direction and being movable in relation to said third wall element and said fourth wall element, said second elongated core element comprising a third cooperating member interacting with said third actuator member of said third wall element and a fourth cooperating member interacting with said fourth actuator member of said fourth wall element for allowing said third wall element and said fourth wall element to selectively define said non-extended state or said extended state in said longitudinal direction by moving said second elongated core element in said longitudinal direction relative to said third wall element and said fourth element, and said first wall element, said second wall element and said first elongated core element together constituting a first part of said elongated pelt board, and said third wall element, said fourth wall element and said second elongated core element together defining a second part of said elongated pelt board.

The above object, the above features and the above advantage together with numerous other objects, advantages and features which will be evident from the below detailed description of the present invention are according to a fourth aspect of the present invention obtained by a method of manufacturing a pelt board for accommodating an animal pelt comprising:

providing a first wall element defining a first outwardly oriented surface, a first inwardly oriented surface, a first set of oppositely located longitudinal edges and a first actuator member, providing a second wall element defining a second outwardly oriented surface, a second inwardly oriented surface, a second set of oppositely located longitudinal edges and a second actuator member, said first wall element and said second wall element being of identical configuration, positioning said first and second wall elements extending along a longitudinal direction and having said first inwardly oriented surface facing said second inwardly oriented surface together defining a first cavity along said longitudinal direction, said first wall element and said second wall element defining:

a contracted state in which said longitudinal edges of said first wall element being positioned juxtaposed said longitudinal edges of said second wall element, and an expanded state in which said first longitudinal edges of said first wall element and said longitudinal edges of said second wall element being shifted away from one another relative to said contracted state along said first radial direction and/or along said second radial direction, and the method comprising:

providing a first elongated core element and positioning said first elongated core element extending within said first cavity along said longitudinal direction and being movable in relation to said first wall element and said second wall element, said first elongated core element comprising a first cooperating member interacting with said first actuator member of said first wall element and a second cooperating member interacting with said second actuator member of said second wall element, for allowing said first wall element and said second wall element, to selectively define said contracted state or said expanded state by moving said first elongated core element in said longitudinal direction relative to said first wall element and said second wall element, and said first wall element, said second wall element and said first elongated core element together constituting a first part of said elongated pelt board, the method providing a closure element for closing off an open end of said first part and a second elongated core element connected to said closure element positioning said second elongated core element extending within said first cavity along said longitudinal direction and being movable in relation to said first part to selectively define said non-extended state or said extended state in said longitudinal direction, said closure element and said second elongated core element together constituting a second part of said elongated pelt board, said closure element defining:

a non-extended state in said longitudinal direction in which said closure element of said second part is positioned juxtaposed said first part, and an extended state in which said closure element of said second part is spaced from said first part along said longitudinal direction.

The above method according to the third and fourth aspects may preferably be used together with the pelt board according to the first and second aspects. The wall elements and the elongated core are preferably made as separate molded plastic items. The wall elements are typically snap fitted together. In some cases, the first wall element and the second wall element may constitute two or more items which are snap fitted together.

DETAILED DESCRIPTION OF THE DRAWINGS

Figure 1A:
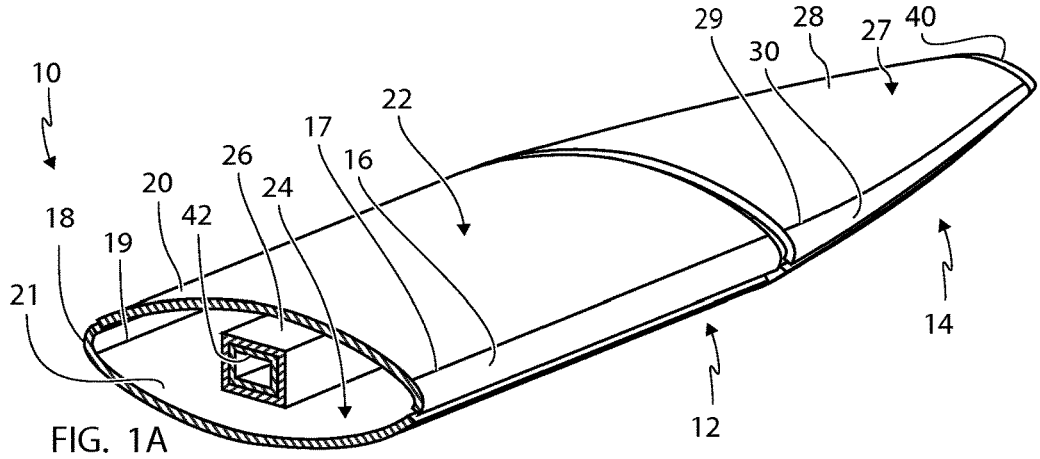
FIGS. 1A and 1B are a series illustration schematically a first embodiment of a pelt board according to the present invention in a non-expanded and non-extended state.

FIG. 1A shows a perspective view of a part of a first embodiment of a pelt board 10 in its contracted or non-expanded and non-extended state. The left-hand part of the pelt board shown in FIG. 1A is designated the reference numeral 12 and named the first part of the pelt board, and the right-hand part of the pelt board 10 is designated the reference numeral 14 and named the second part of the pelt board.

The first part 12 of the pelt board 10 is composed of a total of three components, namely two identically shaped shell parts 22 and 24 and a first elongated core element 26.

Each of the shell parts 22 and 24 comprise a major low curvature wall part 20 and 21, respectively, and a minor high curvature wall part 16 and 18, respectively. The major low curvature wall parts 20 and 21 are joined to the minor high curvature parts 16 and 18, respectively, through imaginary lines 17 and 19, respectively.

The first embodiment of the pelt board 10 shown in FIG. 1A is of a structure, in which the two identically shaped shell parts 22 and 24 of the first part 12 of the pelt board 10 in the non-expanded and non-extended states shown in FIG. 1A constitute an almost perfectly configured elliptical cross sectional configuration as the longitudinal edges of the oppositely positioned shell parts 20 and 24 join one another in a basically unbroken elliptically cross sectional configuration. The elliptical cross sectional configuration of the first part 12 of the pelt board 10 shown in FIG. 1A is believed to improve the ability of the pelt board 10 to allow an easy removal of the pelt from the pelt board after the tanning of the pelt as the outer surface of the pelt board in its contracted and collapsed state is almost "perfectly" uniform without any substantive discontinuities.

The second part 14 of the pelt board 10 constitutes a geometrical extension or continuation of the first part 12 and defines a tapering configuration defining a pointed open-end which is closed off by a closure element 40. The second part 14 comprises two shell parts like the first part being composed of the shell parts 22 and 24, however, in FIG. 1A, only one shell part 27 of the second part 14 is shown composed of a major wall part 28 constituting the geometrical extension of the low curvature wall part 20 and a minor wall part 30 constituting the geometrical extension of the high curvature wall part 16 of the first part 12 which wall parts 28 and 30 are joined along an imaginary line 29 extending as a linear continuation of the imaginary line 17.

The interior of the first part 12 defines a first cavity which cavity is designated the reference numeral 25 and in which the first elongated core element or rod 26 is positioned centrally and defining a central throughgoing passage in which a further or second elongated core element or rod 42 is received which second elongated core element is at its end opposite to the end shown in the left-hand part of FIG. 1A connected to an inner concealed surface of the closure element 40.

Figure 1B:
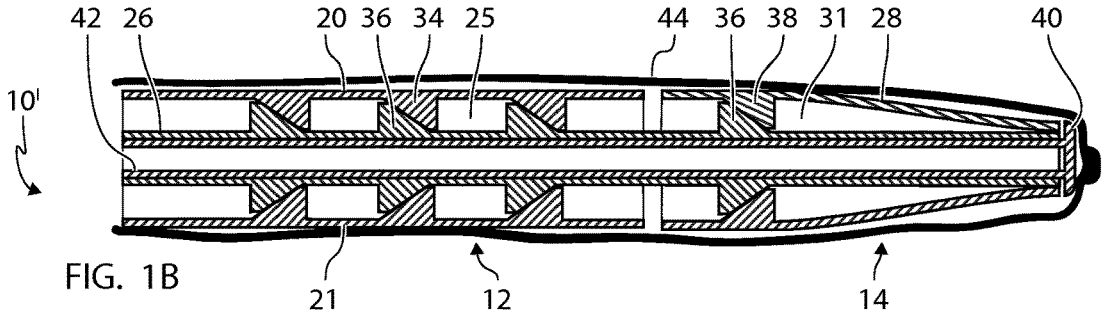

FIG. 1B shown a vertical sectional view through the pelt board 10 in FIG. 1A disclosing the first inner cavity 25 of the first part 12 and further disclosing an inner cavity of the second part 14 which cavity constitutes a second inner cavity designated the reference numeral 31. In FIG. 1B, a pelt is designated the reference numeral 44 received on the pelt board 10 and within the first cavity 25 and the second cavity 31, the first elongated core element 26 is provided with actuator members 36 serving to cooperate with actuator member 36 of the first elongated core element 26. The actuator members 34 and 36 define sloping surfaces serving to push the shell parts 22 and 24 away from one another as the first elongated core element 26 is pushed to the right i.e. into the inner cavity 25 of the first part 12 of the pelt board 10. The second part 14 of the pelt board 10 is also provided with actuator members 38 serving the same purpose as the actuator members 36 of the first part 12, namely to cause the two shell parts of the second part one of which is designated the reference numeral 27 to be pushed away from one another for establishing an expanded state as will be described below with reference to FIGS. 3A and 3B.

Figure 2A:
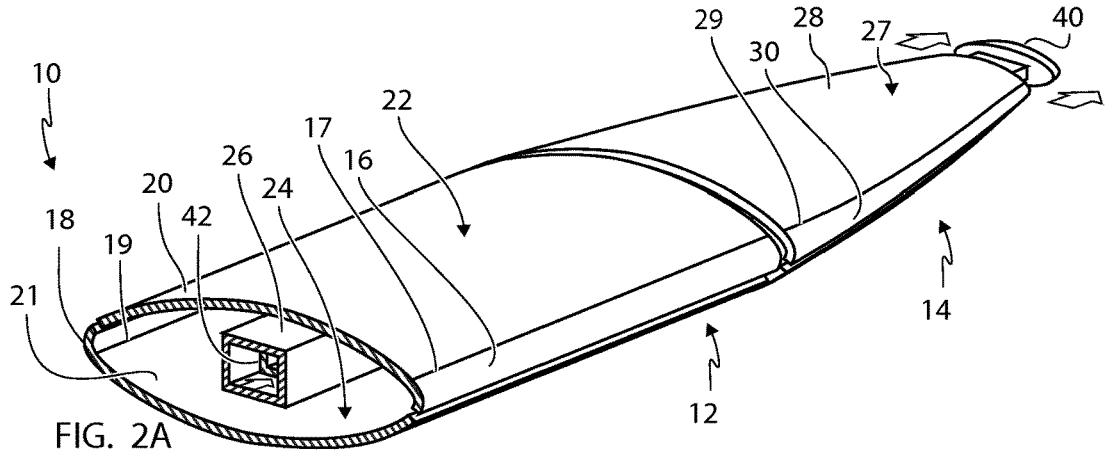
FIGS. 2A and 2B are a series similar to the series of FIGS. 1A and 1B, respectively, illustrating the first embodiment of the pelt board according to the present invention in a non-expanded and extended state.
Figure 2B:
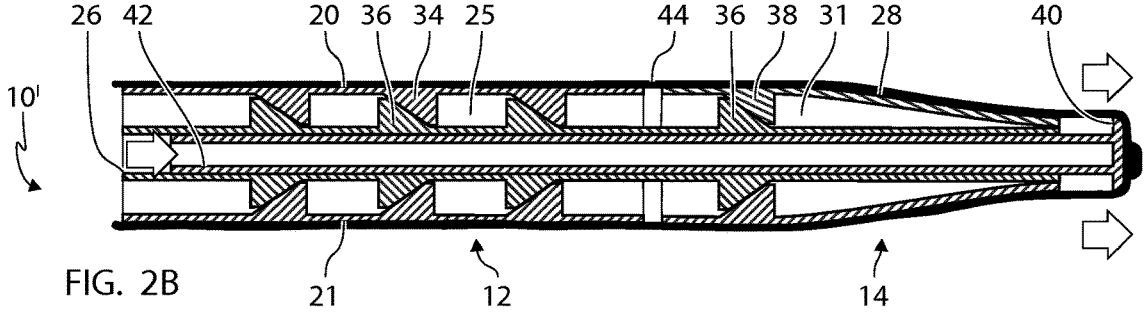

In FIG. 1B, the second elongated core element 42 is further shown connected to the closure element 40 serving, as is illustrated in FIGS. 2A and 2B, to allow the closure element 40 to be pushed away from the pointed end of the second part 14 of the pelt board 10 as is indicated by arrows in FIGS. 2A and 2B. By the shifting of the closure element 40 to the right shown in FIGS. 2A and 2B, the pelt 44 is as is illustrated in FIG. 2B stretched as compared to the relaxed state shown in FIG. 2A.

Figure 3A:
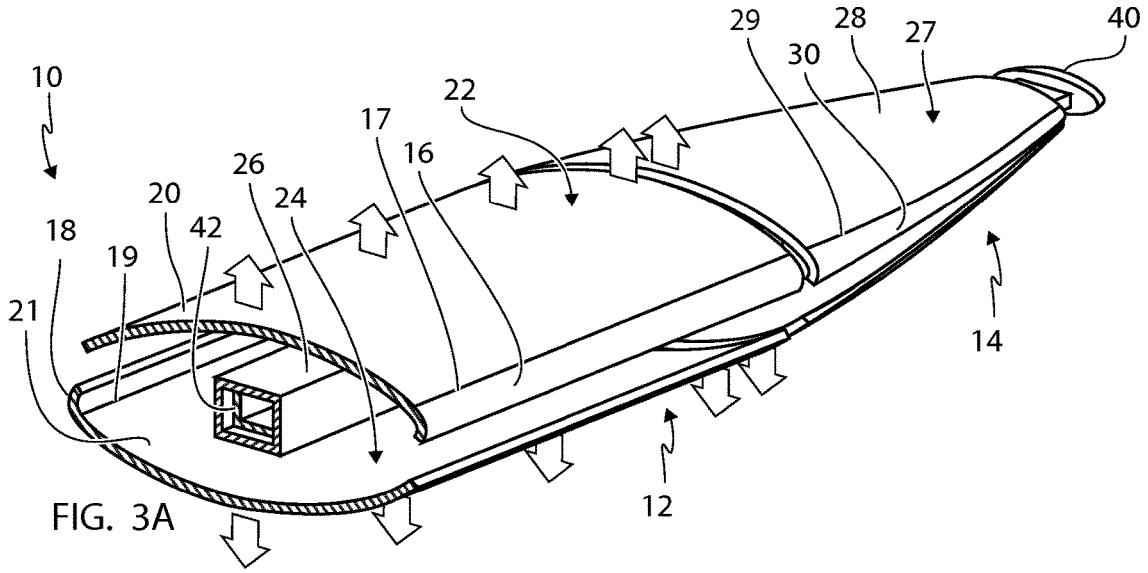
FIGS. 3A and 3B are a series similar to the series of FIGS. 1A and 1B, respectively, illustrating the first embodiment of the pelt board according to the present invention also shown in FIGS. 2A and 2B in an expanded and extended state.
Figure 3B:
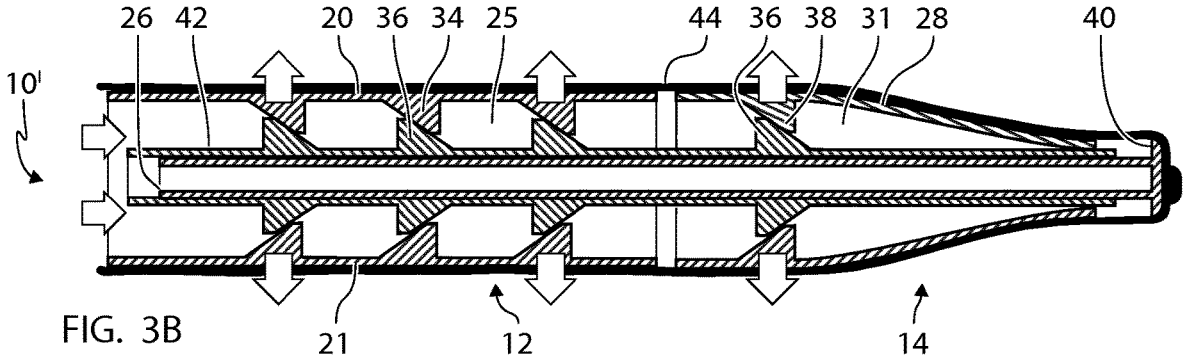

In FIGS. 3A and 3B, the pelt board 10 is shifted to an expanded state as the first elongated core element 26 is shifted to the right as compared to the position of the first elongated core element 26 shown in FIG. 1B which causes the actuator members 39 to push or to act upon the actuator members 36 of the first part 12 causing the shell parts 22 and 24 to be pushed away from one another and establishing an expanded state, at the same time, the actuator members 38 of the second part 14 of the pelt board causes the shell parts one of which is designated the reference numeral 27 of the second part 14 of the pelt board 10 to be shifted away from one another as is illustrated in FIG. 3B by the pushing of the actuator members 38 away from one another. In FIG. 3B, the shifting of the first elongated core element 26 is designated by arrows at the left-hand end of FIG. 3B.

Figure 4A:
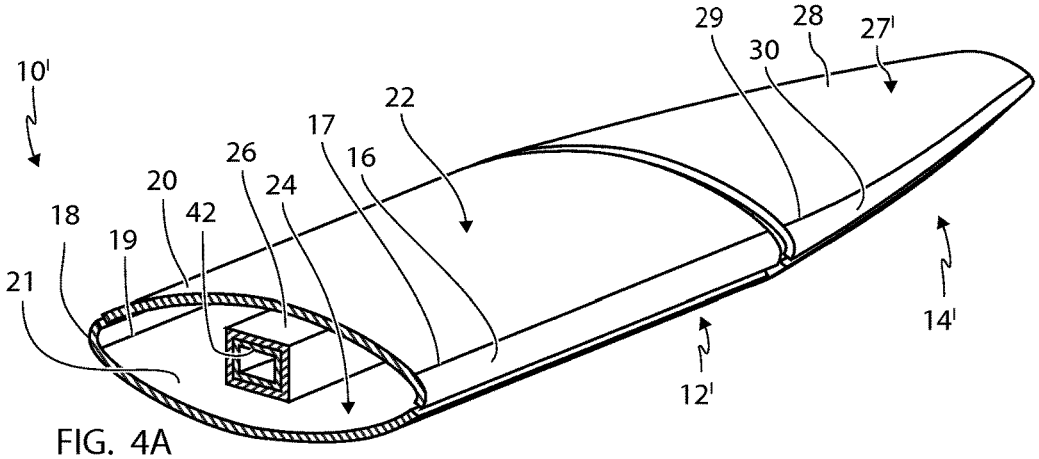
FIGS. 4A and 4B are a series illustrating schematically a second embodiment of the pelt board according to the present invention in a non-expanded and non-extended state.
Figure 4B:
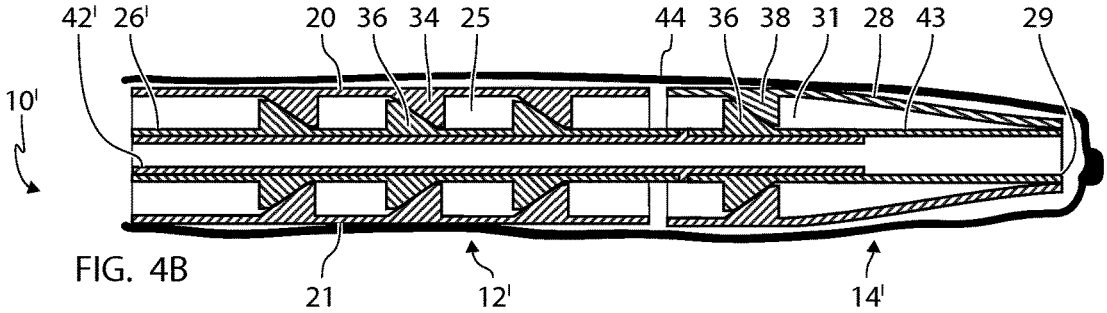

In FIGS. 4A and 4B a second embodiment of the pelt board 10 according to the present invention is shown, which embodiment is designated the reference numeral $\mathbf{10}^{I}$ in its entity. In FIGS. 4A and 4B and the remaining drawings figures, alternative embodiments of the pelt board according to the present invention is shown and in the drawings, components or elements identical to previously described components or elements, respectively, are designated the same references as described above and no supplementary description is given, whereas components or elements serving the same purpose as previously described components or elements, respectively, are designated the same reference numeral, however, added a marking to identify the geometrical amendment or the different geometrical shape as compared to the previously described component or element, respectively. The second embodiment $\mathbf{10}^{I}$ shown in FIGS. 4A and 4B basically differ from the above described first embodiment 10 in that the closure element 40 is omitted and for establishing the feature of allowing the pelt board $\mathbf{10}^{I}$ to be extended from the non-extended state shown in FIGS. 4A and 4B, the second elongated core element 42' is joined to the second part 14' of the pelt board 10 I' for allowing the second part 14' to be shifted to an extended state as compared to the non-extended and non-expanded state of the pelt board $\mathbf{10}^{I}$ shown in FIGS. 4A and 4B.

Figure 5A:
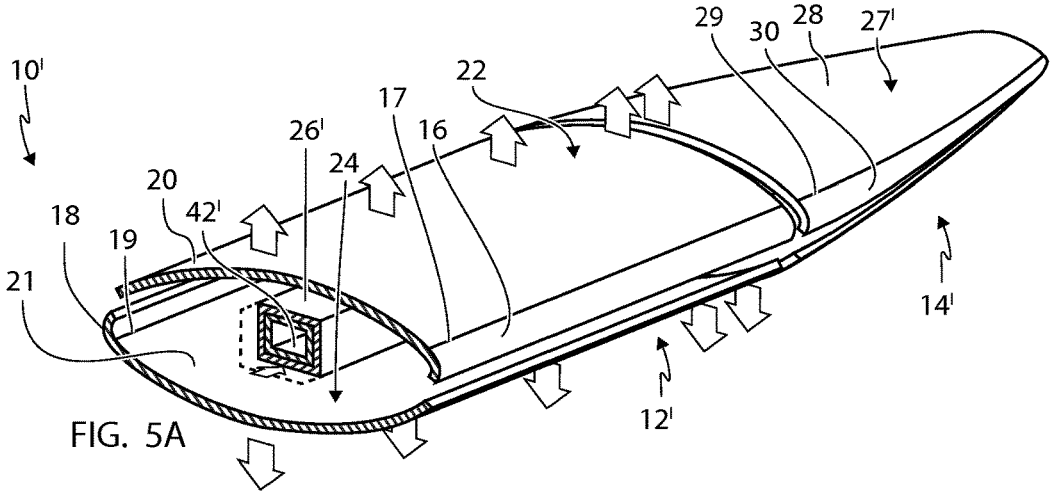
FIGS. 5A and 5B are a series similar to the series of FIGS. 4A and 4B, respectively, illustrating the second embodiment of the pelt board according to the present invention in an expanded and non-extended state.
Figure 5B:
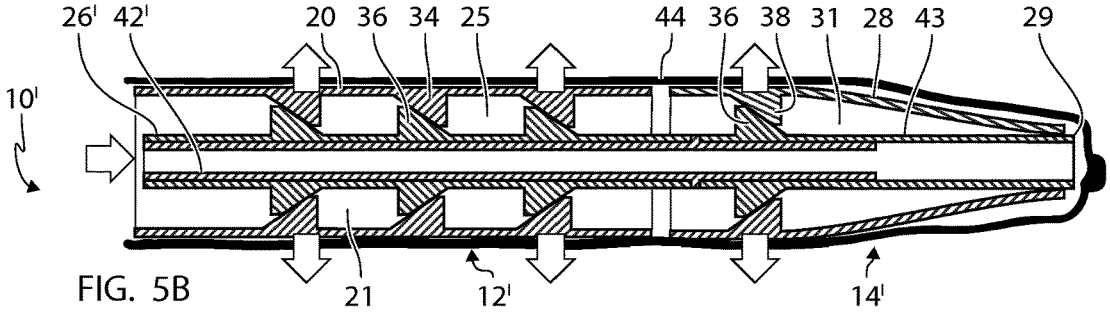

In FIGS. 5A and 5B, the second embodiment $\mathbf{10}^{I}$ of the pelt board according to the present invention is shown in its expanded state caused by the interaction between the actuator members 36 of the first part 12 and the actuator members 39 of the first elongated core element 26 further cooperating with the actuator members 38 of the second part 14' of the pelt board 10'.

The shifting of the second embodiment $\mathbf{10}^{I}$ of the pelt board according to the present invention from the non-extended state shown in FIGS. 4A and 4B and further in FIGS. 5A and 5B to its extended state is accomplished by shifting the second part 14' of the pelt board 10' to the right as will be illustrated in more detail in connection with the modified embodiment in FIGS. 7A and 7B as the first elongated core element 26' is divided into two parts, a first part remaining in the inner cavity 25 of the first part 12 of the pelt board 10' and a second part being forced to the right as the second elongated core element is forced forward within the interior of the first elongated core element 26'. The separate second part of the first elongated core element 26' is designated the reference numeral 43.

Figure 6A:
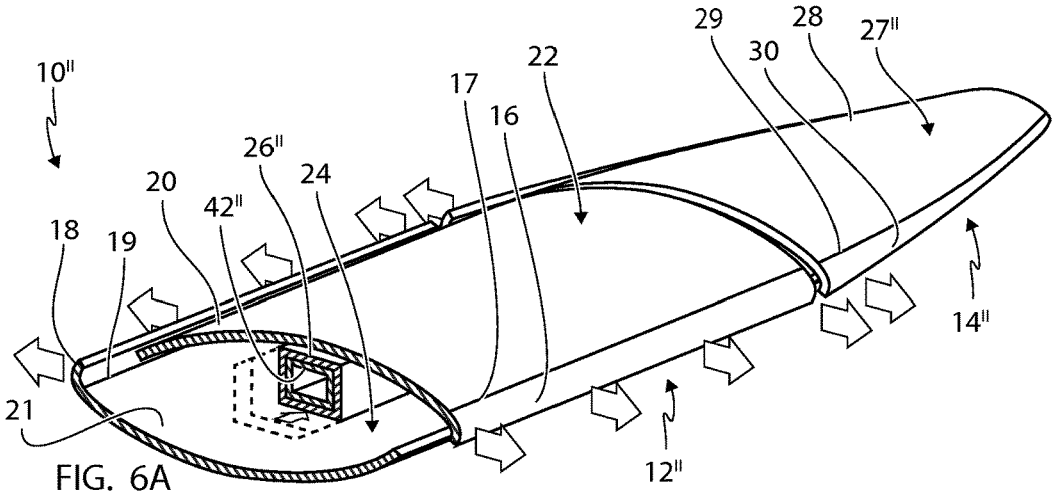
FIGS. 6A and 6B are a series similar to the series of FIGS. 5A and 5B, respectively, illustrating the second embodiment of the pelt board according to the present invention also shown in FIGS. 5A and 5B in an alternative expanded and non-extended state.
Figure 6B:
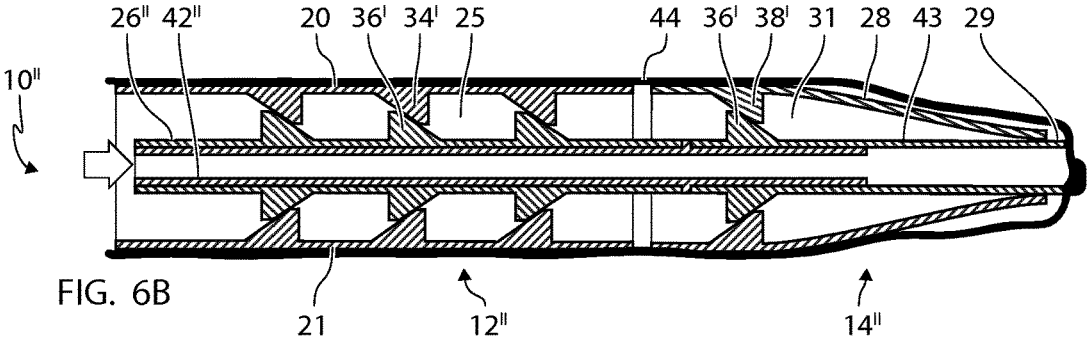

In FIGS. 6A and 6B, a modified version of the second embodiment of the pelt board according to the present invention is shown designated the reference numeral $\mathbf{10}^{II}$ in its entirety. Whereas in the second embodiment $\mathbf{10}^{I}$ shown in FIGS. 4A, 4B, 5A and 5B, the shift from the contracted state or non-expanded state to the expanded state is accomplished by shifting or pushing the shell parts of the first part and the second part of the pelt board away from one another, the shifting from the contracted or non-expanded state to the expanded state in the modified embodiment $\mathbf{10}^{II}$ shown in FIGS. 6A and 6B is accomplished by shifting the shell parts 22 and 24 of the first part 12" and likewise the shell parts of the second part 19" sideways relative to one another as indicated by the arrows shown in FIG. 6A. For accomplishing the sideways shifting of the shell parts 22 and 24 of the first part 12" and likewise the shell parts of the second part 14" in the modified second embodiment $\mathbf{10}^{II}$ shown in FIG. 6A, the actuator members 34' and 36' are acting sideways and shifted from pushing vertically as shown in FIG. 5A to shifting horizontally as illustrated in FIG. 6B.

Figure 7A:
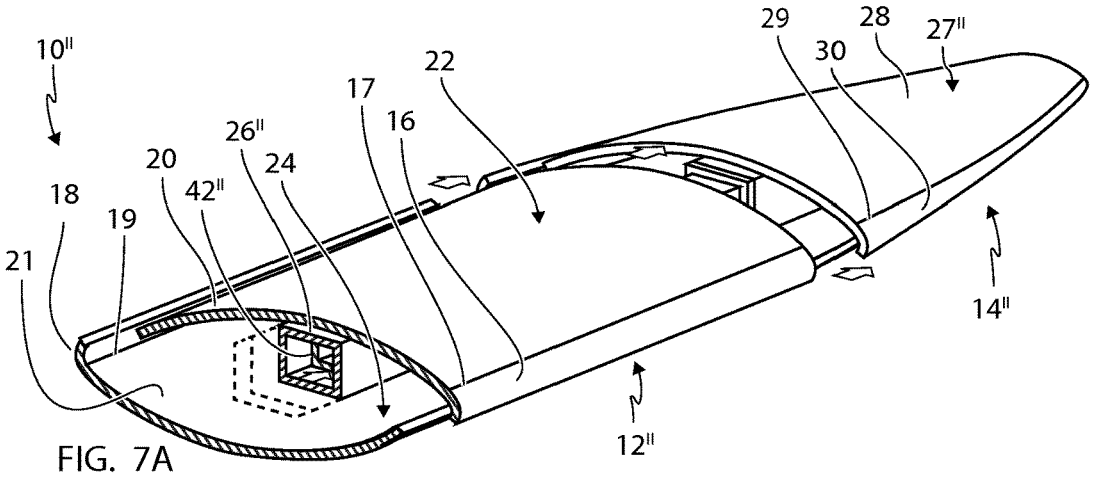
FIGS. 7A and 7B are a series similar to the series of FIGS. 4A and 4B, respectively, illustrating the second embodiment of the pelt board according to the present invention in the expanded state shown in FIGS. 6A and 6B and further in an extended state.
Figure 7B:
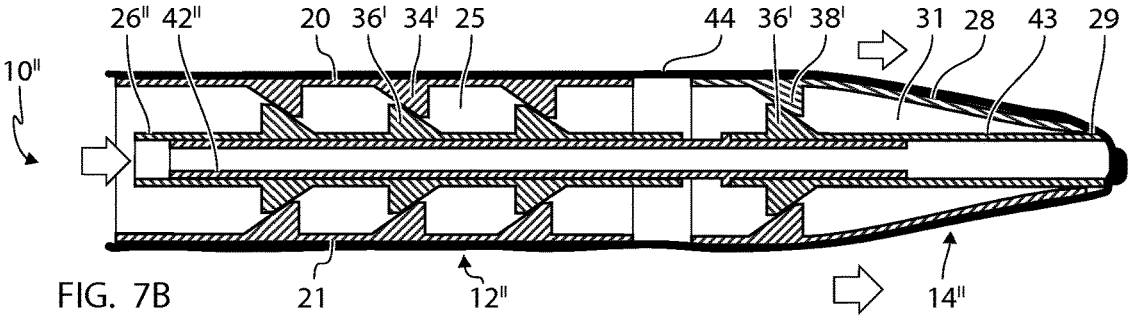

In FIGS. 7A and 7B, the modified second embodiment of the pelt board $\mathbf{10}^{II}$ is shown in its extended and expanded states as the second part 14" is shifted away from the first part 12' by the pushing of the second part 12" to the right by separating the second part 43 of the first elongated core element 26' as is briefly discussed above as the shifting of the second embodiment 10' shown in FIGS. 4A and 4B and the shifting of the modified second embodiment $\mathbf{10}^{II}$ shown in FIGS. 6A and 6B from the non-extended to the extended state is in both embodiments accomplished in the same manner as described above.

Figure 8A:
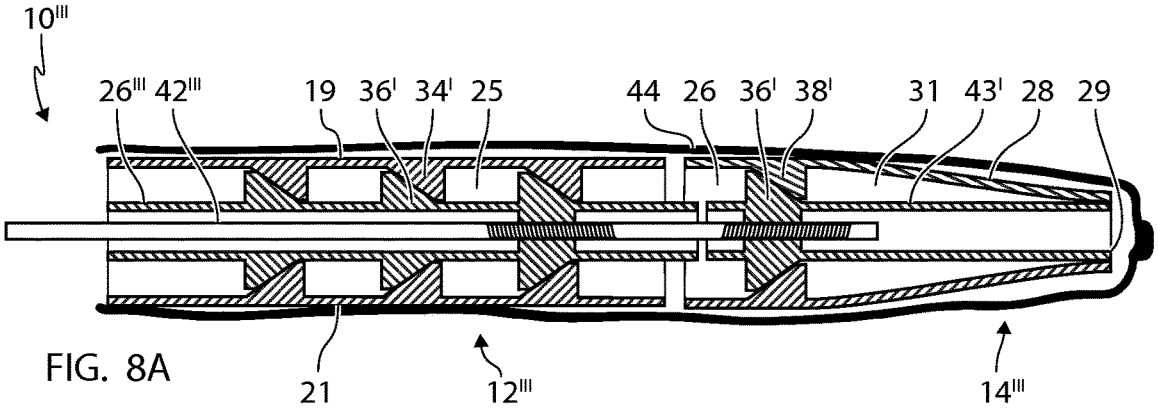
FIGS. 8A, 8B and 8C are a series of a further embodiment of the pelt board according to the present invention differing from the above second embodiment in the actuating of the expanded and extended states shown in FIGS. 4B, 5B and 7B, respectively.
Figure 8B:
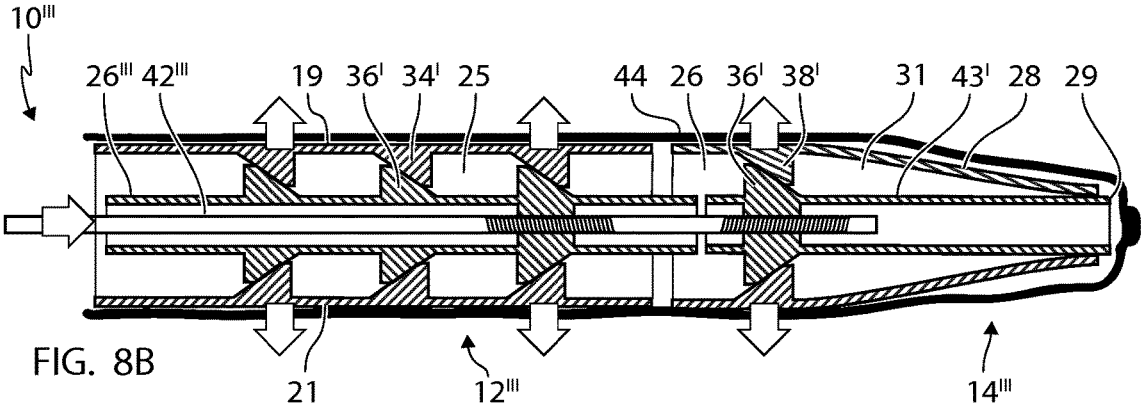
Figure 8C:
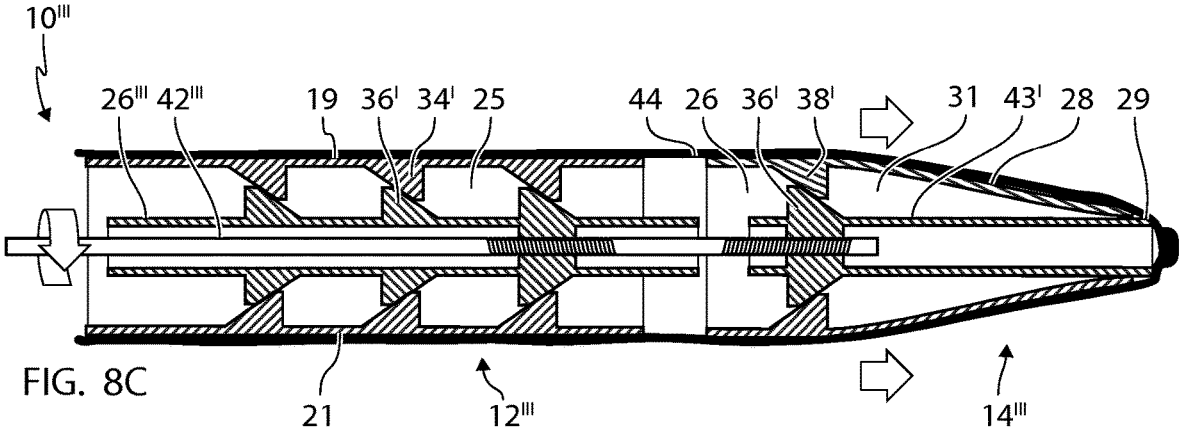

In FIGS. 8A, 8B, and 8C, a variant of the second embodiment 10' of the pelt board shown in FIGS. 4A and 4B is shown as the second elongated core element of the variant $\mathbf{10}^{III}$ shown in FIG. 8A is constituted by a rod $\mathbf{42}^{III}$ having opposite threads cooperating with two actuator members $\mathbf{36}^{I}$ of the first part $\mathbf{12}^{III}$ and the second part $\mathbf{14}^{III}$ respectively, of the pelt board $\mathbf{10}^{III}$, which actuator members $\mathbf{36}^{I}$ are pushed away from one another as the second elongated core element $\mathbf{42}^{II}$ is turned or rotated as is indicated by an arrow in FIG. 8C. The expansion of the modified pelt board $\mathbf{10}^{III}$ shown in FIG. 8A from its contracted or non-expanded state shown in FIG. 8A to its expanded state is accomplished in the same manner as described above with reference to FIGS. 4B and 5B by the cooperation between the actuator members $\mathbf{34}^{I}$ of the shell parts 22 and 24 and the actuator members $\mathbf{36}^{I}$ and likewise the cooperation between actuator members $\mathbf{38}^{I}$ of the second part $\mathbf{14}^{III}$ and the actuator members $\mathbf{36}^{I}$.

Figure 9A:
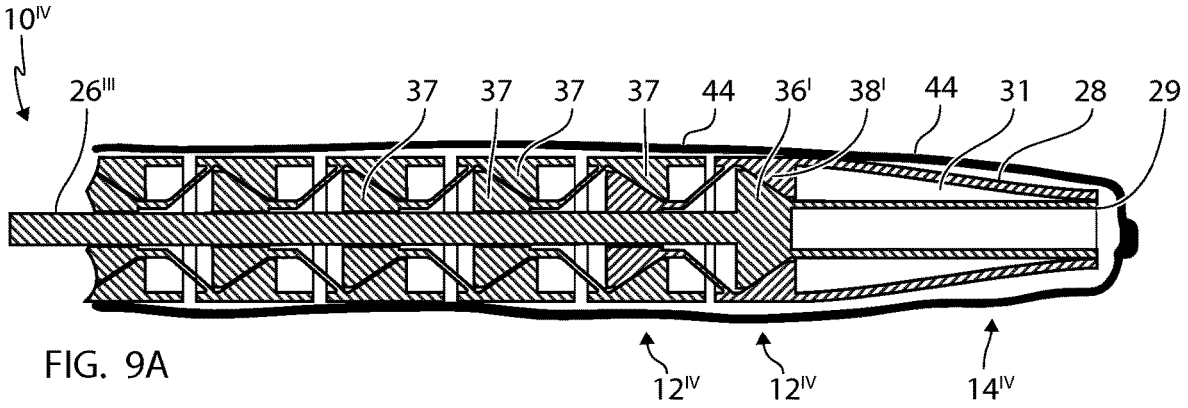
FIGS. 9A and 9B are a series illustrating a further alternative embodiment of the pelt board according to the present invention including a single actuator for the shifting between non-expanded and non-extended states and expended and extended states.
Figure 9B:
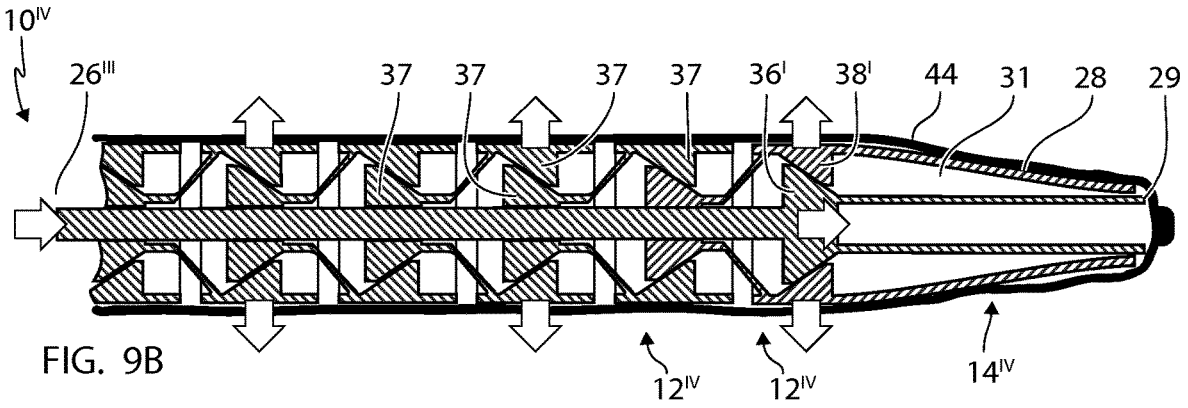

In FIGS. 9A and 9B, a further embodiment $\mathbf{10}^{IV}$ of the pelt board according to the present invention is shown which includes a segmented first part $\mathbf{12}^{IV}$ constituted by a total of five individual segments which are together shifted from contracted or non-expanded state to expanded state and at the same time shifted from non-extended to extended state as the two elongated core elements are combined into a single elongated core element $\mathbf{26}^{III}$ which at its front end act on the second part $\mathbf{14}^{IV}$ as a single actuator member $\mathbf{36}^{I}$ of the elongated core element $\mathbf{26}^{III}$ acts upon the actuator members $\mathbf{38}^{II}$ of the second part $\mathbf{14}^{IV}$ of the pelt board $\mathbf{10}^{IV}$. The individual segments $\mathbf{12}^{IV}$ of the pelt board $\mathbf{10}^{IV}$ together constituting a first part of the pelt board each include a single actuator member 37 acting on the actuator members $\mathbf{36}^{I}$ of the segment $\mathbf{12}^{IV}$ positioned left to the segment in question and in cooperating with the actuator members $\mathbf{36}^{I}$ of the neighboring segment firstly pushes the shell parts away from one another and shifts the shell parts sideways as illustrated in FIGS. 3A and 6A, respectively, and at the same time forces the segment to the right causing a separation of the segmented elements $\mathbf{12}^{IV}$ providing an overall lengthening of the first part of the pelt board $\mathbf{10}^{IV}$.

Although the present invention has above been described with reference to presently preferred embodiments of the pelt board and although the above described embodiments may readily be combined by altering the shifting from contracted or non-expanded state to expanded state or shifting the pelt board from non-extended state to extended state by rearranging the actuator members in question, the pelt board according to the present invention may further be modified in accordance with the teachings of the applicant's two previously filed European patent applications EP 14199640.5, publication number EP 3 037 557, filed on 22 Dec. 2014, and, European patent application EP 14199651.2, also filed on 22 Dec. 2014.

The above mentioned European patent applications have been continued in an international application EP2015/

056431, publication number WO2015/144774, filed on the 25 Mar. 2015 and claiming the priority of the above mentioned European patent applications EP 14199640.5 and EP 14199651.2. The above mentioned published applications EP 3 037 557 and WO2015/144774 are hereby incorporated by reference.

LIST OF REFERENCE NUMERALS

10. Pelt board
12. First part
14. Second part
16. Minor high curvature wall part
17. Imaginary line
18. High curvature wall part
19. Imaginary line
20. Major low curvature wall part
21. Major low curvature wall part
22. Shell part
24. Shell part
25. First cavity
26. First elongated core element
27. Shell part
28. Major wall part
29. Imaginary line
30. Minor wall part
31. Second cavity
34. Actuator member
36. Actuator member
38. Actuator member
40. Closure element
42. Second elongated core element
43. Second part
44. Pelt

The invention claimed is:

1. A pelt board for accommodating an animal pelt, said pelt board defining a blunt end and an opposite pointed end and defining a longitudinal direction between said blunt end and said pointed end, said pelt board further defining a first radial direction perpendicular to said longitudinal direction and a second radial direction perpendicular to said longitudinal direction and said first radial direction, said pelt board comprising:

(a) a first part at said blunt end, said first part comprising:

(1) a first wall element extending along said longitudinal direction and defining a first outwardly oriented surface, a first inwardly oriented surface, a first set of oppositely located longitudinal edges, and a first actuator member;

(2) a second wall element extending along said longitudinal direction and defining a second outwardly oriented surface, a second inwardly oriented surface facing said first inwardly oriented surface, a second set of oppositely located longitudinal edges, and a second actuator member;

said first inwardly oriented surface and said second inwardly oriented surface together defining a first cavity along said longitudinal direction;

said first wall element and said second wall element defining:

(i) a contracted state in which said first set of oppositely located longitudinal edges of said first wall element are positioned juxtaposed said second set of oppositely located longitudinal edges of said second wall element; and (ii) an expanded state in which said first set of oppositely located longitudinal edges of said first wall element and said second set of oppositely located longitudinal edges of said second wall element are shifted away from one another relative to said contracted state along at least one of said first radial direction and said second radial direction; and (3) a first core element extending within said first cavity along said longitudinal direction and movable in relation to said first wall element and said second wall element, said first core element comprising a first cooperating member interactable with said first actuator member of said first wall element and a second cooperating member interactable with said second actuator member of said second wall element, whereby said first wall element and said second wall element selectively define said contracted state and said expanded state when said first core element is moved in said longitudinal direction relative to said first wall element and said second wall element; and (b) a second part at said pointed end, said second part comprising:

(1) a third wall element extending along said longitudinal direction and defining a third outwardly oriented surface, a third inwardly oriented surface, a third set of oppositely located longitudinal edges and a third actuator member;

(2) a fourth wall element extending along said longitudinal direction and defining a fourth outwardly oriented surface, a fourth inwardly oriented surface facing said third inwardly oriented surface, a fourth set of oppositely located longitudinal edges and a fourth actuator member;

said third inwardly oriented surface and said fourth inwardly oriented surface together defining a second cavity along said longitudinal direction;

said third wall element and said fourth wall element defining:

(i) a non-extended state in said longitudinal direction in which said second part is positioned juxtaposed said first part, and said third set of oppositely located longitudinal edges and said fourth set of oppositely located longitudinal edges constitute extensions of said first set of oppositely located longitudinal edges and said second set of oppositely located longitudinal edges, respectively; and (ii) an extended state in which said second part is spaced from said first part along said longitudinal direction as said third set of oppositely located longitudinal edges and said fourth set of oppositely located longitudinal edges do not constitute extensions of said first set of oppositely located longitudinal edges and said second set of oppositely located longitudinal edges, respectively; and (3) a second core element extending within said second cavity along said longitudinal direction and being movable in relation to said third wall element and said fourth wall element, said second core element comprising a third cooperating member interactable with said third actuator member of said third wall element and a fourth cooperating member interactable with said fourth actuator member of said fourth wall element, whereby said third wall element and said fourth wall element selectively define said non-extended state and said extended state in said longitudinal direction when said second core element is moved in said longitudinal direction relative to said third wall element and said fourth element.

2. The pelt board of claim 1, wherein the first wall element has a first configuration, the second wall element has a second configuration identical to the first configuration, the third wall element has a third configuration, and the fourth wall element has a fourth configuration identical to the third configuration.

3. The pelt board of claim 1, wherein said first core element extends to said blunt end, and said second core element extends in a through-going passage within said first core element to said blunt end.

4. The pelt board of claim 1, wherein each of said third actuator member and said fourth actuator member includes a wedge member configured for contacting said third cooperating member and said fourth cooperating member, respectively.

5. The pelt board of claim 1, wherein each of said third cooperating member and said fourth cooperating member includes a wedge member configured for contacting said third actuator member and said fourth actuator member, respectively.

6. The pelt board of claim 1, wherein said third actuator member and said fourth actuator member respectively engage said third cooperating member and said fourth cooperating member opposite said second core element.

7. The pelt board of claim 1, wherein said pelt board has an exterior, and wherein at least one of said first wall element, said second wall element, said third wall element and said fourth wall element defines an opening between at least one of said first cavity and said second cavity and the exterior of said pelt board at a first end of any one of the respective first, second, third, and fourth wall elements, for allowing ventilation air to enter said at least one of said first cavity and said second cavity.

8. The pelt board of claim 1, wherein said first wall element and said second wall element are fixedly connected at a first end of the first and second wall elements.

9. The pelt board of claim 1, wherein one or more of said first wall element, said second wall element, said third wall element, and said fourth wall element have an arched shape such that at least one of said first outwardly oriented surface, said second outwardly oriented surface, said third outwardly oriented surface, and said fourth outwardly oriented surface defines a convex shape.

10. The pelt board of claim 1, wherein said first core element and said second core element are defined by a single element.

11. A pelt board for accommodating an animal pelt, said pelt board defining a blunt end and an opposite pointed end and defining a longitudinal direction between said blunt end and said pointed end, said pelt board further defining a first radial direction perpendicular to said longitudinal direction and a second radial direction perpendicular to said longitudinal direction and said first radial direction, said pelt board comprising:

(a) a first part defining a first opening at said blunt end and comprising:

(1) a first wall element extending along said longitudinal direction and defining a first outwardly oriented surface, a first inwardly oriented surface, a first set of oppositely located longitudinal edges, and a first actuator member;

(2) a second wall element and extending along said longitudinal direction and defining a second outwardly oriented surface, a second inwardly oriented surface facing said first inwardly oriented surface, a second set of oppositely located longitudinal edges, and a second actuator member;

said first inwardly oriented surface and said second inwardly oriented surface together defining a first cavity along said longitudinal direction;

said first wall element and said second wall element defining:

(i) a contracted state in which said first set of oppositely located longitudinal edges of said first wall element are positioned juxtaposed said second set of oppositely located longitudinal edges of said second wall element; and (ii) an expanded state in which said first set of oppositely located longitudinal edges of said first wall element and said second set of oppositely located longitudinal edges of said second wall element are shifted away from one another relative to said contracted state along at least one of said first radial direction and said second radial direction; and (3) a first core element extending within said first cavity along said longitudinal direction and movable in relation to said first wall element and said second wall element, said first core element comprising a first cooperating member interactable with said first actuator member of said first wall element and a second cooperating member interactable with said second actuator member of said second wall element, whereby said first wall element and said second wall element selectively define said contracted state and said expanded state in said longitudinal direction when said first core element is moved in said longitudinal direction relative to said first wall element and said second wall element; and (b) a second part defining a second opening at said pointed end, said second part comprising:

(1) a closure element configured for closing off said second opening and defining:

(i) a non-extended state in said longitudinal direction in which said closure element of said second part is positioned to close said second opening; and (ii) an extended state in which said closure element of said second part is spaced from said first part second opening along said longitudinal direction; and (2) a second core element connected to said closure element and extending within said first cavity along said longitudinal direction being movable in relation to said first part to selectively define said non-extended state and said extended state.

12. The pelt board of claim 11, wherein the first wall element has a first configuration, and the second wall element has a second configuration identical to the first configuration.

13. The pelt board of claim 11, wherein said first core element extends to said blunt end, and said second core element extends in a through-going passage within said first core element to said blunt end.

14. The pelt board of claim 11, wherein each of said first actuator member and said second actuator member includes a wedge member configured for contacting said first cooperating member and said second cooperating member, respectively.

15. The pelt board of claim 11, wherein each of said first cooperating member and said second cooperating member includes a wedge member configured for contacting said first actuator member and said second actuator member, respectively.

16. The pelt board of claim 11, wherein said first actuator member and said second actuator member respectively engage said first cooperating member and said second cooperating member opposite said first core element.

17. The pelt board of claim 11, wherein said pelt board has an exterior, and wherein at least one of said first wall element and said second wall element defines an opening between said first cavity and the exterior of said pelt board at a first end of at least one of the respective first and second wall elements for allowing ventilation air to enter said first cavity.

18. The pelt board of claim 11, wherein at least one of said first wall element and said second wall element has an arched shape such that at least one of said first outwardly oriented surface and said second outwardly oriented surface defines a convex shape.

19. A method of manufacturing a pelt board for accommodating an animal pelt comprising:

providing a first wall element defining a first outwardly oriented surface, a first inwardly oriented surface, a first set of oppositely located longitudinal edges, and a first actuator member;

providing a second wall element defining a second outwardly oriented surface, a second inwardly oriented surface, a second set of oppositely located longitudinal edges, and a second actuator member;

positioning said first and second wall elements extending along a longitudinal direction having said first inwardly oriented surface facing said second inwardly oriented surface together defining a first cavity along said longitudinal direction;

said first wall element and said second wall element defining:

a contracted state in which said longitudinal edges of said first wall element being positioned juxtaposed said longitudinal edges of said second wall element; and an expanded state in which said first longitudinal edges of said first wall element and said longitudinal edges of said second wall element being shifted away from one another relative to said contracted state along at least one of said first radial direction and said second radial direction;

positioning a first core element to extend within said first cavity along said longitudinal direction and to be movable in relation to said first wall element and said second wall element, said first core element comprising a first cooperating member interacting with said first actuator member of said first wall element and a second cooperating member interacting with said second actuator member of said second wall element, for allowing said first wall element and said second wall element to selectively define said contracted state and said expanded state by moving said first core element in said longitudinal direction relative to said first wall element and said second wall element;

providing a third wall element defining a third outwardly oriented surface, a third inwardly oriented surface, a third set of oppositely located longitudinal edges, and a third actuator member;

providing a fourth wall element defining a fourth outwardly oriented surface, a fourth inwardly oriented surface, a fourth set of oppositely located longitudinal edges, and a fourth actuator member;

positioning said third and fourth wall elements extending along said longitudinal direction and having said third inwardly oriented surface facing said fourth inwardly oriented surface;

having said third inwardly oriented surface facing said fourth inwardly oriented surface together defining a second cavity along said longitudinal direction;

said third wall element and said fourth wall element defining:

a non-extended state in said longitudinal direction in which said second part is positioned juxtaposed said first part and said third set of oppositely located longitudinal edges and said fourth set of oppositely located longitudinal edges constitute extensions of said first set of oppositely located longitudinal edges and said second set of oppositely located longitudinal edges, respectively; and an extended state in which said second part is spaced from said first part along said longitudinal direction as said third set of oppositely located longitudinal edges and said fourth set of oppositely located longitudinal edges are not constituting extensions of said first set of oppositely located longitudinal edges and said second set of oppositely located longitudinal edges, respectively;

positioning a second core element to extend within said second cavity along said longitudinal direction and to be movable in relation to said third wall element and said fourth wall element, said second core element comprising a third cooperating member interacting with said third actuator member of said third wall element and a fourth cooperating member interacting with said fourth actuator member of said fourth wall element, for allowing said third wall element and said fourth wall element to selectively define said non-extended state and said extended state in said longitudinal direction by moving said second core element in said longitudinal direction relative to said third wall element and said fourth element, and said first wall element, said second wall element and said first core element together constituting a first part of said pelt board, and said third wall element, said fourth wall element and said second core element together defining a second part of said pelt board.

20. A method of manufacturing a pelt board for accommodating an animal pelt comprising:

providing a first wall element defining a first outwardly oriented surface, a first inwardly oriented surface, a first set of oppositely located longitudinal edges, and a first actuator member;

providing a second wall element defining a second outwardly oriented surface, a second inwardly oriented surface, a second set of oppositely located longitudinal edges, and a second actuator member;

positioning said first and second wall elements extending along a longitudinal direction and having said first inwardly oriented surface facing said second inwardly oriented surface together defining a cavity along said longitudinal direction;

said first wall element and said second wall element defining:

a contracted state in which said first set of longitudinal edges of said first wall element are positioned juxtaposed said second set of longitudinal edges of said second wall element; and an expanded state in which said first set of longitudinal edges of said first wall element and said second set of longitudinal edges of said second wall element are shifted away from one another relative to said contracted state along at least one of a first radial direction and a second radial direction;

positioning a first core element to extend within said cavity along said longitudinal direction and to be movable in relation to said first wall element and said second wall element, said first core element comprising a first cooperating member interacting with said first actuator member of said first wall element and a second cooperating member interacting with said second actuator member of said second wall element, for allowing said first wall element and said second wall element to selectively define said contracted state and said expanded state by moving said first core element in said longitudinal direction relative to said first wall element and said second wall element;

said first wall element, said second wall element, and said first core element together constituting a first part of said pelt board, said first part of said pelt board having a pointed end and an opening at said pointed end;

providing a closure element configured for closing off the opening at said pointed end of said first part, the closure element having a second core element connected thereto;

positioning the second core element to extend within said cavity along said longitudinal direction and to be movable in said longitudinal direction in relation to said first part to selectively define said contracted state and said expanded state, said closure element and said second core element together constituting a second part of said pelt board, said closure element defining:

a non-extended state in said longitudinal direction in which said closure element of said second part is positioned to close the opening at said pointed end of said first part; and an extended state in which said closure element of said second part is spaced from the opening at said pointed end of said first part along said longitudinal direction.

21. The method of claim 20, wherein said second core element extends in a through-going passage within said first core element.

* * * * *